United States Patent [19]

Jai

[11] 4,164,799

[45] Aug. 21, 1979

[54] MACHINE FOR CLEANING TUBES AND PIPES

[76] Inventor: Kenneth Jai, 3425 Durwood Dr., Beaumont, Tex. 77704

[21] Appl. No.: 915,004

[22] Filed: Jun. 13, 1978

[51] Int. Cl.[2] ..... F28G 3/10; B08B 9/02

[52] U.S. Cl. ..... 15/104.1 R; 92/86; 92/171

[58] Field of Search ..... 15/104.1 R; 92/86, 169, 92/171

[56] References Cited

U.S. PATENT DOCUMENTS

| | | | |
|---|---|---|---|
| 2,678,247 | 5/1954 | Geyer et al. | 92/169 X |
| 2,803,842 | 8/1957 | Fuller | 15/104.1 R |
| 3,771,187 | 11/1973 | Dillinger | 15/104.1 R |
| 4,015,304 | 4/1977 | Dillinger | 15/104.1 R |

*Primary Examiner*—Edward L. Roberts

*Attorney, Agent, or Firm*—Edward D. O'Brian

[57] ABSTRACT

The safety of a machine for cleaning tubes and pipes constructed so as to include an elongated cylinder, a piston located within the cylinder, a non-round piston rod attached to the piston so as to extend out of one end of the cylinder and hydraulic components for introducing a high pressure fluid into and out of the ends of the cylinder can be improved by providing a second cylinder which is located concentrically around the first cylinder. A discharge structure is attached to the second cylinder so as to be capable of venting or dissipating any fluid which may enter the second cylinder as a result of rupture of the first to the ambient surroundings. Preferably the discharge structure includes a pressure reducer such as an orifice and preferably the discharge structure is located so that any fluid discharged from it cannot cause damage.

8 Claims, 1 Drawing Figure

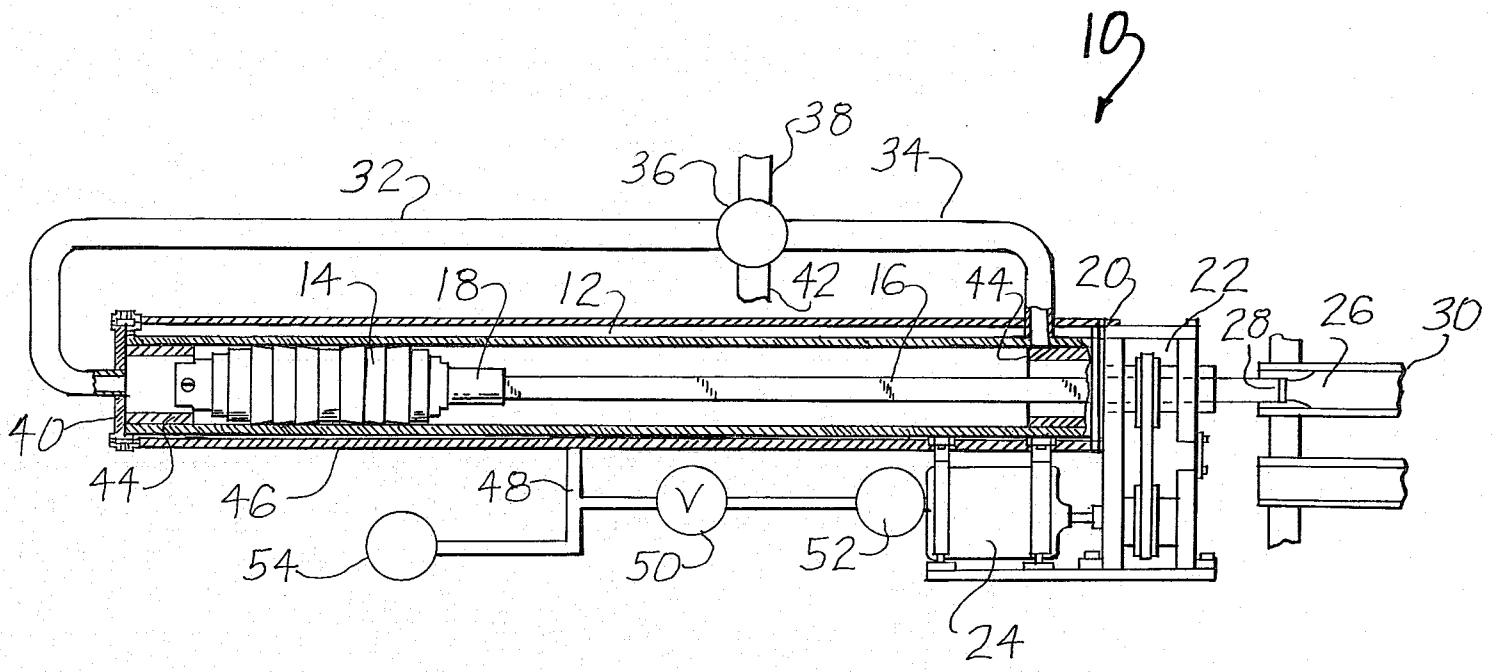
10
30
26
28
22
20
24
44
34
16
52
38
42
36
50
12
48
18
32
14
46
54
44
40

MACHINE FOR CLEANING TUBES AND PIPES

BACKGROUND OF THE INVENTION

The invention set forth in this specification pertains to new and improved pipe cleaning machines of a type commonly utilized in many chemical or process industries for cleaning pipes or tubes such as those employed within heat exchange apparatus and various related types of process equipment.

The pipe cleaning machines of the type to which this invention pertains are normally constructed so as to utilize an enclosed, elongated cylinder within which there is located a piston. A non-round piston rod is normally attached to the piston so as to extend out of one end of the cylinder through a rotary seal mechanism sealing the noted end of the cylinder. A conventional mechanical coupling structure is normally employed so as to transfer rotation from a motor to the piston rod externally of the cylinder. A drill or drill type member is normally mounted on the end of the piston rod remote from the cylinder. Appropriate conduit and valve means are employed so that hydraulic fluid may be moved into and out of the ends of the cylinder in order to move both the piston and the piston rod axially of the cylinder as the apparatus is employed.

During the use of a pipe cleaning machine as indicated in the preceding the machine is mounted on any conveniently available structure so that the piston rod is aligned with a pipe or tube to be cleaned. Then the machine is operated so that the piston and piston rod are moved in order to move the drill or drill type member into the pipe or tube as the piston rod is rotated.

As a result of this action it is possible to effectively remove comparatively hard, tenacious deposits from within the interiors of pipes and tubes used for different, diverse purposes. The difficulty in the removal of such deposits, of course, varies in accordance with the nature of such deposits. As a result of comparative difficulty in removing certain types of deposits it is considered desirable to construct such machines so that comparatively high pressure hydraulic fluids are applied to the cylinder employed in such a machine in order to move the piston and the attached drill rod and similar tool toward such a deposit.

Because the cylinders employed in such machines are comparatively long, are preferably constructed so as to have comparatively thin walls, and because there is a chance of such cylinders being damaged to a degree so as to be weakened as they are transported from one location to another for use in cleaning out different types of tubes it is considered that there is an element of danger involved in the use of such comparatively high pressure fluids in such machines. Such danger relates to a chance that such a cylinder might be ruptured by the pressure of the fluid employed. Such rupture would result in hydraulic fluid squirting out of the cylinder in such a manner as to present a hazard. As a result of this it is considered that there is a need to improve pipe cleaning machines as indicated in the preceding so as to lessen the danger resulting from the use of comparatively high pressure hydraulic fluids in such machines.

SUMMARY OF THE INVENTION

A broad objective of the present invention is to fulfill the need indicated in the preceding discussion. Another object of the present invention is to provide new and improved pipe cleaning machines which are not significantly more expensive than prior machines, which operate in the same manner as prior machines and which minimize the safety hazard resulting from the use of comparatively high pressure hydraulic fluids in such prior machines.

In accordance with this invention these objectives are achieved by providing in a pipe cleaning machine including: an enclosed, elongated cylinder, a piston located within the cylinder, a non-round piston rod attached to the piston so as to extend out of one end of the cylinder, control means for introducing a high pressure fluid into and out of the ends of the cylinder, rotary seal means for forming a seal around said piston at said end of said cylinder, and motion transmitting means for rotating said piston rod during movement of said piston the improvement which comprises: a second enclosed cylinder located concentrically around said first mentioned cylinder so as to provide an enclosed space around said first mentioned cylinder throughout the length of said first mentioned cylinder, and discharge means for discharging any fluid from within said space in the event of rupture of said first mentioned cylinder.

BRIEF DESCRIPTION OF THE DRAWING

Because of the nature of the invention it is best more fully described with reference to the accompanying drawing in which:

The FIGURE is a partial cross-sectional view in which certain parts are shown in elevation and in which certain parts are shown in diagrammatic manner illustrating the nature of a presently preferred pipe cleaning machine in accordance with this invention.

The machine illustrated in the drawing utilizes the concepts of the invention verbally expressed in the appended claims. It will be realized that various different known pipe cleaning machines are or can be constructed in various different manners so as to differ from one another as to various details within the scope of routine engineering skill. For this reason the invention is not to be considered as being limited to the precise structure shown in the drawing but instead is to be considered as being limited solely by the appended claims.

DETAILED DESCRIPTION

In the drawing there is shown a pipe cleaning machine 10 in accordance with this invention. This machine 10 includes an enclosed, elongated first cylinder 12 within which there is located a piston 14 which is adapted to move back and forth along the length of the cylinder 12 as the machine 10 is used. A non-round, preferably square piston rod 16 is attached to one end (not separately numbered) of the piston 14 by means of a conventional coupling unit 18.

This piston rod 16 extends out of the cylinder 12 through a known type of rotary seal 20 and then extends through a known or conventional motion transmitting structure 22 which is utilized to transmit motion from a conventional motor 24 to the rod 16 as the machine 10 is operated. A blade or other related cleaning tool 26 is mounted on the end 28 of the rod 16 remote from the cylinder 14 so that as the machine 10 is used this blade 26 may be utilized to remove deposits (not shown) from the interior of the tube or pipe 30 located in alignment with the rod 16.

During the use of the machine 10 for such cleaning purposes the machine 10 is, of course, preferably mounted in a conventional manner so that the relative position of the machine 10 to the pipe 30 will not change. Since suitable mounting structures are well known no such structure is illustrated. The machine 10 also includes lines 32 and 34 which are connected to a conventional control valve 36. These lines 32 and 34 are used to convey a hydraulic fluid (not shown) from a pipe 38 supplied with high pressure hydraulic fluid (not shown) to either an end plate 40 closing off the end (not separately numbered) of the cylinder 12 remote from the seal 20 or to the end (not separately numbered) of the cylinder 12 adjacent to the seal 20.

The valve 36 also is connected to another pipe 42 used in carrying "spent" hydraulic fluid from ends (not numbered) of the cylinder 12 during the operation of the machine 10. If desired, and preferably, cylindrical elastomeric bumpers 44 may be located within the cylinder 12 so as to limit the movement of the piston 14 and so as to absorb any forces developed during rapid movement of the piston 14 as it is moved into contact with either of these bumpers 44.

In accordance with this invention the machine 10 described in the preceding is improved by mounting another cylinder 46 concentrically around the cylinder 12 so that it is spaced from the cylinder 12 throughout the length of the cylinder 12. One end (not separately numbered) of the cylinder 46 may be secured directly to the plate 40 and the other end (not separately numbered) may be secured to the rotary seal 20 or to another equivalent structural member attached or carried by the cylinder 12 in a conventional manner. This cylinder 46 serves to protect the cylinder 12 from physical damage.

A pipe 48 is preferably connected to the cylinder 46 so as to be capable of bleeding off from within the space between the cylinders 12 and 46 hydraulic fluid (not shown). Preferably this pipe 48 includes a pressure reducing means such as either a conventional valve 50 or an orifice 52 for the purpose of limiting the rate at which high pressure fluid can be discharged through the pipe 48. Preferably the orifice 52 takes the form of a discharge nozzle which is directed at any solid part of the machine 10 such as the motor 24 so as to break up any flow through the orifice 52 by impinging such a stream against a solid surface so as to minimize the chances of damage. In a structure such as is shown the orifice 52 is conveniently a spray nozzle which will spray against such a part so as to reduce force concentrations against such a part in the event the second cylinder 46 is used in accordance with this invention.

Such use occurs if for any reason the cylinder 12 should rupture so as to permit high pressure hydraulic fluid to move externally of this cylinder 12. With the invention any such fluid will move into the space between the cylinders 12 and 46. Any such fluid entering within this space will be bled off gradually through the pipe 48 in a manner which is not apt to present any significant hazard and which is not apt to cause any significant damage. Further, because of the pressure releasing action achieved in accordance with this invention in the event of such rupture the pressure change within the cylinder 12 will tend to be minimized. As a consequence of this unless such rupture is of any unexpected nature normally it will be possible to use the pressure within the cylinder 12 to withdraw the drill blade 26 from the tube 30 after such a rupture has occurred. This will facilitate the machine 10 being placed in a condition such that it can be moved in an established manner to be repaired.

If desired a conventional accumulator 54 may be connected to the pipe 48 so as to "take up" any initial surge of pressure resulting from the rupture of the pipe 12. Such an accumulator 54 is considered to be desirable in maintaining pressure between the cylinders 12 and 46 in the event of a rupture as noted so as to facilitate withdrawal of the drill blade 26 with minimum difficulty.

I claim:

1. A pipe cleaning machine including an enclosed, elongated cylinder, a piston located within said cylinder, a non-round piston rod attached to said piston so as to extend out of one end of said cylinder, control means for introducing a high pressure fluid into and out of the ends of said cylinder, rotary seal means for forming a seal around said piston at said end of said cylinder, and motion transmitting means for rotating said piston rod during movement of said piston in which the improvement comprises:

a second enclosed cylinder located concentrically around said first mentioned cylinder so as to provide an enclosed space around said first mentioned cylinder throughout the length of said first mentioned cylinder, and discharge means for discharging any fluid within said space in the event of rupture of said first mentioned cylinder.

2. A machine as claimed in claim 1 wherein:

said discharge means comprises a pipe leading from the space between said second cylinder and said first mentioned cylinder.

3. A machine as claimed in claim 1 wherein:

said pipe has an outlet directed against a solid part of said machine.

4. A machine as claimed in claim 2 wherein:

said discharge means includes a pressure reducing means for reducing the pressure of fluid connected to said pipe.

5. A machine as claimed in claim 4 wherein:

said pressure reducing means is an orifice.

6. A machine as claimed in claim 5 wherein:

said orifice is a spray nozzle, and said spray nozzle is directed against a solid part of said machine.

7. A machine as claimed in claim 6 wherein:

said discharge means includes an accumulator connected to said pipe.

8. A machine as claimed in claim 1 wherein:

said discharge means includes means for reducing the pressure of fluid flowing through said discharge means.

* * * * *